US008684894B2

(12) United States Patent
Flynn

(10) Patent No.: US 8,684,894 B2
(45) Date of Patent: Apr. 1, 2014

(54) MULTIPURPOSE MODULAR EXERCISE AND FITNESS APPARATUS

(76) Inventor: Thomas S. Flynn, Larkspur, CA (US)

( * ) Notice: Subject to any disclaimer, the term of this patent is extended or adjusted under 35 U.S.C. 154(b) by 26 days.

(21) Appl. No.: 12/474,676

(22) Filed: May 29, 2009

(65) Prior Publication Data

US 2010/0016132 A1 Jan. 21, 2010

Related U.S. Application Data

(60) Provisional application No. 61/130,308, filed on May 29, 2008.

(51) Int. Cl.
*A63B 21/02* (2006.01)

(52) U.S. Cl.
USPC ..... 482/125; 482/124; 482/122; 482/121

(58) Field of Classification Search
USPC ..... 482/121–127, 74; 119/795–798
See application file for complete search history.

(56) References Cited

U.S. PATENT DOCUMENTS 5,873,328 A * 2/1999 Campbell ..... 119/798
6,322,482 B1 * 11/2001 Kim ..... 482/124
7,087,001 B1 * 8/2006 Ihli ..... 482/115
7,621,856 B1 * 11/2009 Keith et al. ..... 482/127
2003/0153441 A1 * 8/2003 Berns et al. ..... 482/128
2004/0018922 A1 * 1/2004 Maiuri ..... 482/124
2005/0124471 A1 * 6/2005 Wilkinson ..... 482/121
2006/0183609 A1 * 8/2006 Flynn ..... 482/124
2006/0201450 A1 * 9/2006 Jordan et al. ..... 119/796
2008/0058180 A1 * 3/2008 Clarke et al. ..... 482/126

* cited by examiner

*Primary Examiner* — Oren Ginsberg
*Assistant Examiner* — Sundhara Ganesan
(74) *Attorney, Agent, or Firm* — Larry D. Johnson

(57) ABSTRACT

An apparatus for performing stretching and strengthening exercises for the human body includes a substantially non-elastic strap segment having a first end and a second end, a strap housing connected to the strap segment first end with a mechanism to lock the strap at a desired length of extension from the housing, an elastic resistance band having a first end and a second end, with the elastic resistance band first end connected to the strap segment second end, and an anchor point releasably connected to the elastic resistance band second end. A user can grasp the strap housing either directly or by a handle or bar, adjust the length of the strap and elastic resistance band, and affix the anchor point to a cuff, loop, stirrup, or other article to perform stretching and strengthening exercises. Alternatively, the strap housing can itself be affixed to a glove, mat, bracket, or other article, and the anchor point grasped by or secured to the user to perform exercises.

21 Claims, 4 Drawing Sheets

MULTIPURPOSE MODULAR EXERCISE AND FITNESS APPARATUS

CROSS REFERENCE TO RELATED APPLICATIONS

The present application claims the benefit of the filing date of U.S. Provisional Patent Application Ser. No. 61/130,308, filed May 29, 2008.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The present invention relates generally to exercise equipment and sports apparatus, and more specifically to an improved method and apparatus for performing stretching and strengthening exercises for the human body.

BACKGROUND INFORMATION AND DISCUSSION OF RELATED ART

U.S. Pat. No. 410,778 to Bidwell discloses an apparatus for use in the exercising of the wrists, forearms, and fingers, consisting of a supporting attachment, an elastic strap secured thereto, and finger and hand attachments arranged for connection with the supporting attachment.

U.S. Pat. No. 2,498,006 to Ridill describes a device for training in golf including an elongated member having at least a part thereof resiliently stretchable, a wrist encircling element at one end of the member adapted to be attached to the wrist of a person, and a device at the opposite end of the member adapted to be attached to the heel of a foot of the person, the elongated member being of such length that when connected with the wrist and heel and extended around the outside of the leg carrying the foot it yieldingly resists upward movement of the arm and yieldingly draws upwardly on the heel when the arm is raised, and the member being freely swingable across the front of the person when the arm with, which the member is connected swings from one side to the other as in a golf stroke.

U.S. Pat. No. 5,372,565 to Burdenko teaches a universal exercise machine comprising a bell portion, which is to be fixed as a conventional belt to the waist of the user. The belt portion has on its upper and lower sides rings for the attachment of elastic straps which are connected to the hands, legs, and head of the user, for various exercises based on the application of force required for the stretching of the elastic straps. A distinguishing feature of the machine is the provision of an integrated back support, which may comprise a portion of the belt, or a part connected to the belt portion. The back support has a transverse rigidity greater than the remaining part of the belt portion. Another unique feature of the machine is the provision of floating elements which imparts to the user buoyancy for exercising in the water.

U.S. Pat. No. 5,695,437 to Olschansky, et al. discloses a system particularly directed to exercising gluteal and thigh muscles. The system includes a longitudinally extended handle member and assembly for engaging a heel portion of a user's foot. A resistive force assembly is coupled on a first end to a central portion of the handle member and on an opposing second end to the heel engagement assembly. The resistive force assembly includes an inelastic resistive force subassembly having an inelastic strap member coupled on a first end to handle member and a second end formed in a closed contour. Inelastic resistive force subassembly includes an adjustment buckle for adjusting an overall length dimension of the inelastic strap member. Resistive force assembly includes an elastic resistive force subassembly defined by an elastic strap member having opposing ends thereof coupled to a heel engagement assembly and an intermediate section thereof slidingly coupled to the closed contoured end of inelastic strap member. Heel engagement assembly includes a first band member coupled on opposing ends to respective opposing ends of elastic strap member, a second band member coupled on opposing ends to respective opposing ends of band member, and extending in a transverse direction relative thereto, and a third band member releasably coupled between opposing ends of the first band member.

U.S. Pat. No. 5,813,954 to Wilkinson describes a buttock exercise device. The invention lets the user perform, a whole group of buttock developing motions, working the muscle from many different angles. These motions are enhanced, through the addition of resistance. The resistance may be varied by adjusting the length of the cords and/or interchanging cords of different elastic strengths. The exercise device further has cords and a shoulder and/or neck piece attachment.

U.S. Pat. No. 5,855,539 to Wise teaches a kinesiology testing apparatus which includes a base. A foot treadle is provided having a first end and a second end. The first end is pivotally attached to the base. A line is provided having a first end and a second end. The second end is secured adjacent to the second end of the foot treadle. Means are provided for securing the first end of the line to a person's arm. When a person has his arm extended out parallel to a floor, a downward force exerted by a foot of the person upon the foot treadle is transmits, via the line, a downward force upon the person's arm.

U.S. Pat. No. 5,967,947 to Glover discloses an isometric wrist exercise device which is useful for strengthening the wrist and for treating or alleviating symptoms associated with carpal tunnel syndrome device includes a wrist brace which adjustably encircles a user's wrist. The brace is attached to a swivel plate via a plurality of straps which extend forward from the wrist brace. The swivel plate is attached to an elongate strap with a wedge plate on its opposite end. The wedge plate can secure the elongate strap in a stationary position such that the user can place his wrist in therapeutic traction by pulling his arm against the stationary strap while selectively swiveling his wrist to find the optimum position.

U.S. Pat. No. 6,036,626 to Taylor describes an adjustable resistance exercise device. A continuous loop foot strap is connected to a bungee cord by an O-ring. An opposite end of the bungee cord is looped through a flexible handle and back through a clamping device. A push button actuator permits the size of the handle loop to be adjusted to adjust the overall length of the device to a) enable a different user to adjust the device for her/his needs, b) alter the configuration for use in a different exercise, or c) increase the resistance force afforded by the device as repetition of the various exercises results in strengthening of various muscle groups. Illustrative exercises are discussed.

U.S. Pat. No. 6,368,258 to Emlaw teaches an exercising device including a short strap having an interior surface and an exterior surface with a first end and a second end and an intermediate extent. A first pile-type fastener is provided on the interior surface and a second pile-type fastener on the interior surface. A large buckle has parallel end plates with parallel first and second end cross pieces and a central cross piece. The first end cross piece receives the first end. A long strap has a first end constituting a handle. An intermediate extent of the long strap is coupled to the exterior surface of the short strap.

United States Patent Application 20050137063 by Abdo discloses an exercising device including an elongated tube with a central axis that is filled with a particulate material of a selected weight. The particulate material shifts within the elongated tube to provide flexibility along the length of the tube and wherein the elongated tube compresses when pressure is applied thereto.

United States Patent Application 20060183609 by applicant herein describes a strap apparatus for stretching and strengthening muscles and connective tissue, and includes a segment of strap material having a first end, a medial portion, and a second end, having a loop formed in the first end, length adjustment means formed in the medial portion, and a connector element attached to the second end. The connector element is adapted for releasable connection to an anchor article, e.g., an extremity cuff member or a clothing article, bearing a receiver adapted for releasable attachment to the connector element.

The foregoing patents and patent applications reflect the current state of the art of which the present inventor is aware. Reference to, and discussion of, these patents and applications is intended to aid in discharging Applicant's acknowledged duty of candor in disclosing information that may be relevant to the examination of claims to the present invention. However, it is respectfully submitted that none of the above-indicated patents or applications disclose, teach, suggest, show, or otherwise render obvious, either singly or when considered in combination, the invention described and claimed herein.

SUMMARY OF THE INVENTION

The present invention provides an improved method and apparatus for performing stretching and strengthening exercises for the human body. The inventive modular exercise and fitness apparatus includes a substantially nonelastic strap segment having a first end and a second end, a strap housing connected to the strap segment first end with a mechanism to lock the strap at a desired length of extension from the housing, an elastic resistance band having a first end and a second end, with the elastic resistance band first end connected to the strap segment second end, and an anchor point releasably connected to the elastic resistance band second end. A user can grasp the strap housing either directly or by a handle or bar, adjust the length of the strap and elastic resistance band, and affix the anchor point to a cuff, loop, stirrup, or other article to perform stretching and strengthening exercises. Alternatively, the strap housing can itself be affixed to a glove, mat, bracket, or other article, and the anchor point grasped by or secured to the user to perform exercises.

It is therefore an object of the present invention to provide a new and improved exercise and fitness apparatus.

It is another object of the present invention to provide a new and improved apparatus for performing stretching and strengthening exercises for the human body.

A further object or feature of the present invention is a new and improved exercise apparatus with both nonelastic and elastic portions.

An even further object of the present invention is to provide a novel modular exercise apparatus that can be used in a variety of stretching and strengthening exercises.

Other novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration and description only and are not intended as a definition of the limits of the invention. The various features of novelty which characterize the invention are pointed out with particularity in the claims annexed to and forming part of this disclosure. The invention resides not in any one of these features taken alone, but rather in the particular combination of all of its structures for the functions specified.

There has thus been broadly outlined the more important features of the invention in order that the detailed description thereof that follows may be better understood, and in order that the present contribution to the art may be better appreciated. There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the Abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The Abstract is neither intended to define the invention of this application, which is measured by the claims, nor is it intended to be limiting as to the scope of the invention in any way.

Certain terminology and derivations thereof may be used in the following description for convenience in reference only, and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

BRIEF DESCRIPTION OF THE DRAWINGS

The invention will be better understood and objects other than those set forth above will become apparent when consideration is given to the following detailed description thereof. Such description makes reference to the annexed drawings, wherein.

DETAILED DESCRIPTION OF THE INVENTION

Figure 1:
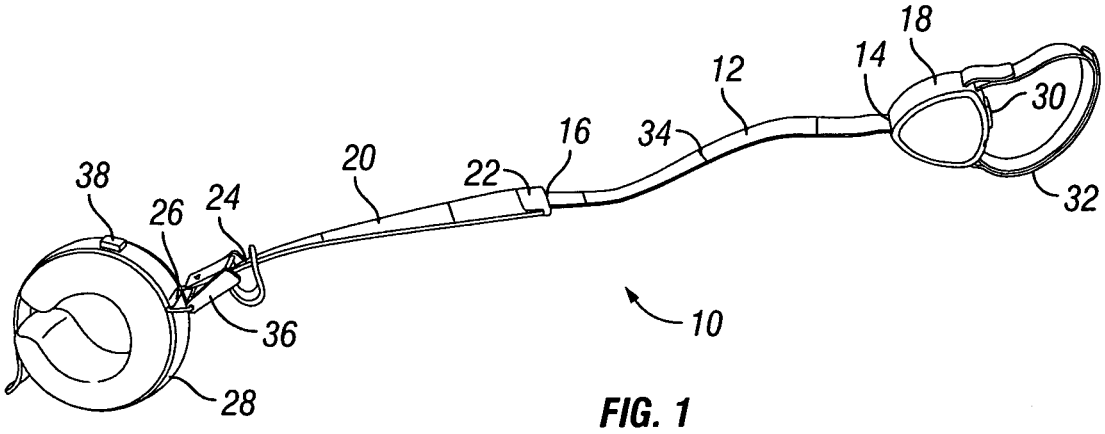
FIG. 1 is a view of a modular exercise and fitness apparatus of this invention, including a nonelastic strap segment, a strap housing, an elastic resistance band, and an anchor point.

Referring to FIGS. 1 through 8, wherein like reference numerals refer to like components in the various views, there is illustrated therein a new and improved modular exercise and fitness apparatus of this invention, generally denominated 10 herein.

FIG. 1 is a view of a modular exercise and fitness apparatus 10 of this invention, including a nonelastic strap segment 12 having a first end 14 and a second end 16, a strap housing 18, an elastic resistance band 20 having a first end 22 and second end 24, and an anchor point 26 secured to an inflatable cuff 28. The strap housing 18 includes means to release or retract the strap such as a button or slide 30 to operate the internal portion of the release-or-retract mechanism.

The strap housing may include a releasable, adjustable strap handle 32. This strap handle can go around the users hand and allows the user to comfortably hold the strap housing and at the same time operate the strap release-or-retract mechanism. The user can also just hold onto the strap handle separately while doing exercises. The strap handle can have padding and can vary in width and other dimensions at least in part by being adjustable.

The strap segment 12 may have length indica 34 such as measurements or colors so that the user can keep track of the length of the strap for respective positions and exercises.

The resistance band 20 may be attached to the strap segment 12 by a releasable means so that the amount of resistance can be varied and so that the resistance band can be changed or replaced. The resistance band may also have indica, measurements, colors or other means so that the user can keep track of the length of the resistance band for respective positions and exercises.

The preferred resistance band has an innovative design such that the amount of resistance can be varied by adjusting the length of the resistance band. One possible method of providing this is to have a resistance band such as a strap of elastic material, which is tapered along its length from wider to narrower. With this particular embodiment, the resistance band could have an opening at the second end 24 so that part of the strap could be taken through the opening. With this embodiment, the strap would also be taken through a means for adjustment and securing such as a clamp or clip 36. This adjustment and securing means could slide along the length of the strap so that it could be secured at any point along the strap and provide for a varying in length of the strap and of resistance—relative to the dimensions of exercise the user is working with.

The change in length of the resistance band will provide a varying amount of cross sectional area of resistance material that the user is working against and hence a varying amount of resistance. For example, the amount of resistance that a user will be working against will be less with a smaller cross sectional area of resistance material (with many resistance materials such as elastic latex rubber or synthetic elastic materials). When the tapered strap is in its full-length position, the resistance encountered will be that of the narrowest part of the tapered resistance strap. In the full-length position, the user will work predominately against that resistance in the narrower portion of the resistance strap until that portion has been elongated to the point that the amount of force applied by the user begins to cause a wider portion of the resistance band to lengthen. It is when the user encounters both the greater effort to further elongate the narrower portion and to elongate the wider portion that additional resistance is encountered and more effort, force or work is required. By sliding the resistance band back up on itself and securing it with the adjustment securing means (clip), the amount of resistance can be increased for the user. Conversely, if the resistance band is released by the adjustment securing means (clip) and pulled through the opening in its strap, the strap can be lengthened and the amount of resistance can be reduced.

The inflatable cuff 28 can go around the hand, wrist, arm, leg, foot, or ankle and in general is a means to attach to the body. The amount of air in the cuff can be increased or decreased with a pump system 38 integral to the cuff. This could allow deflating the cuff to reduce its size for transport. This cuff can also have padding and can vary in width and other dimensions at least in part by being adjustable.

The strap housing could have a soft or flexible material around its exterior edge so the it would be comfortable when held in the users hand. The exterior edge could be raised relative to the edge of the strap housing so that when the strap segment is fully retracted, the resistance band attached to it could be wrapped within the raised edges and be neatly housed and by one of a variety of means, secured there.

The strap housing may have an ergonomically shaped design and padding so that while in use, it would fit properly into the users hand. This ergonomic design and padding would also serve as a means to exercise the hand, possibly in a therapeutic manner. It also would be shaped, padded, or flexible in nature so that it is comfortable against all surfaces of the hand.

Figure 2:
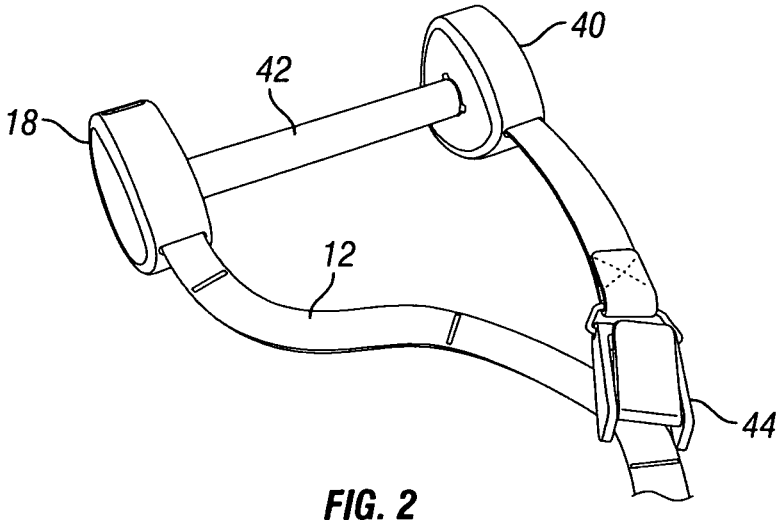
FIG. 2 is a view of a secondary housing and bar handle for use with the apparatus.

FIG. 2 is a view of a secondary housing 40 and bar handle 42 for use with the apparatus. The small dumbbell style handle 42 can be inserted into the side of the strap housing 18 and secondary housing 40 to create the other side of the dumbbell handle end. With this modular system, it also would be possible to have a longer bar for barbell exercises. The secondary housing 40 end could have a short strap and lock-down clip 44 attached to the strap segment 12 which could secure the strap at respective lengths for respective exercises.

Figure 3:
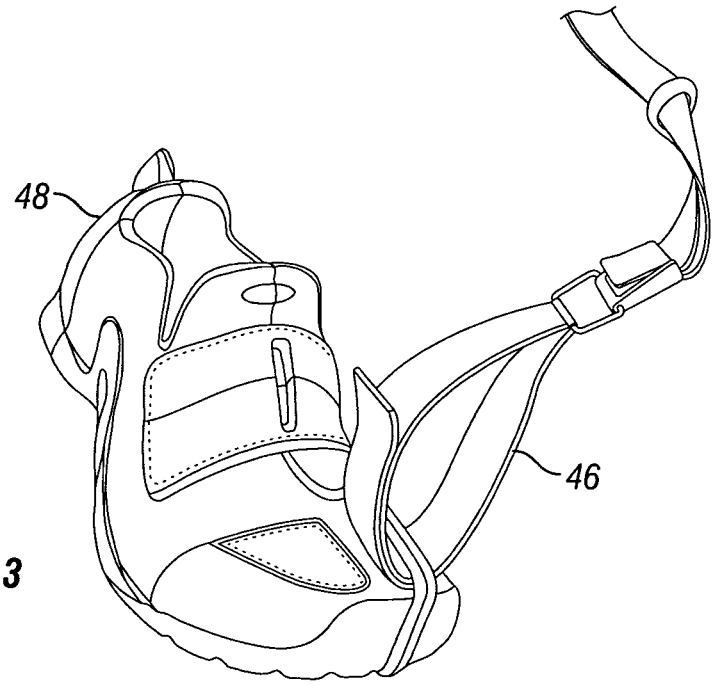
FIG. 3 is a view of a loop-type anchor point as affixed to a shoe.

FIG. 3 is a view of a loop-type anchor point 46 as affixed to a shoe 48.

Figure 4:
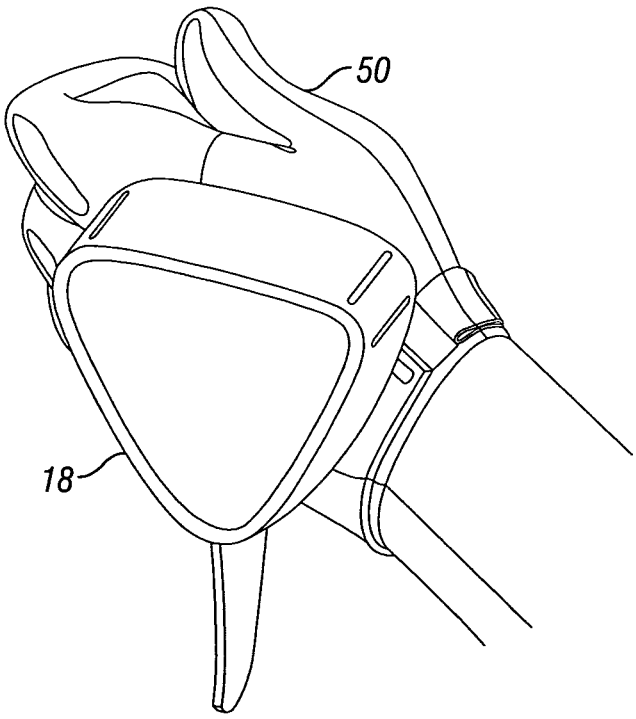
FIG. 4 is a view of the strap housing as affixed to a glove.

FIG. 4 is a view of the strap housing 18 as affixed to a glove 50.

Figure 5:
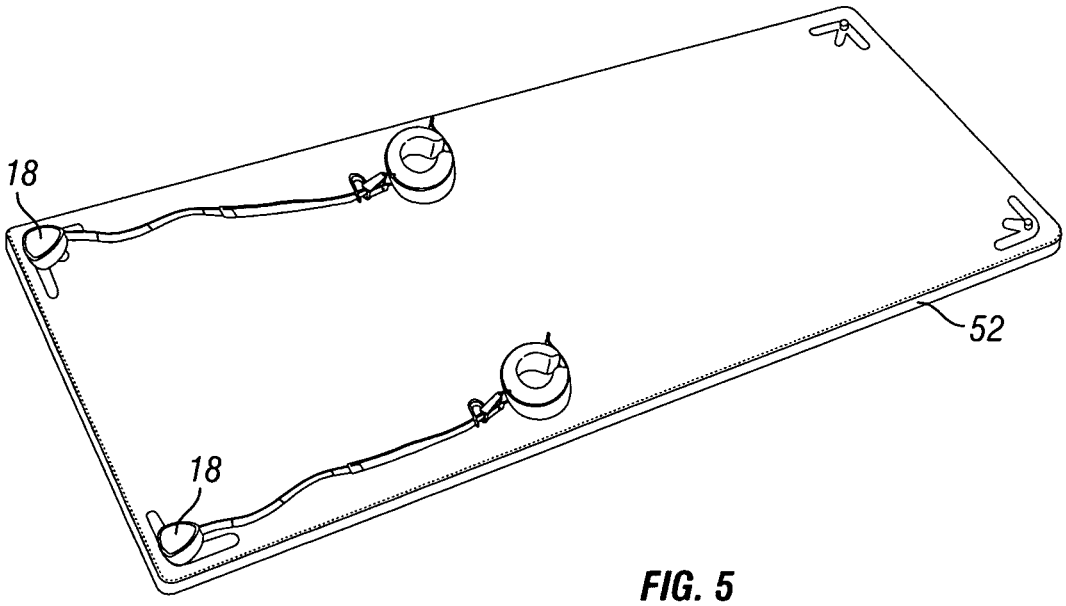
FIG. 5 is a view of a pair of strap housings as affixed to a mat.

FIG. 5 is a view of a pair of strap housings 18 as affixed to a mat 52.

Figure 6:
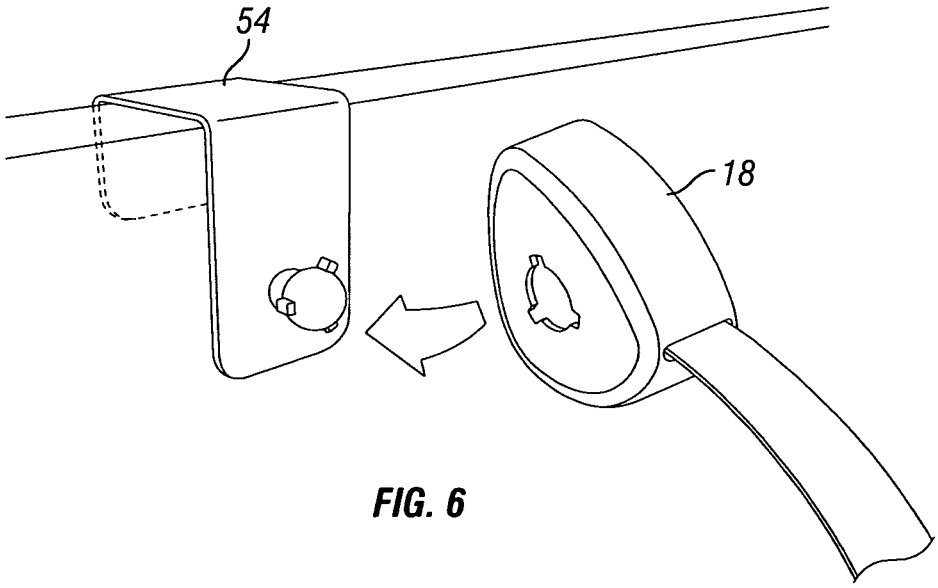
FIG. 6 is a view of a strap housing being affixed to a bracket.

FIG. 6 is a view of a strap housing 18 being affixed to a bracket 54, which can be attached to a door, wall, article of furniture, or other structure, to provide an anchor.

Figure 7:
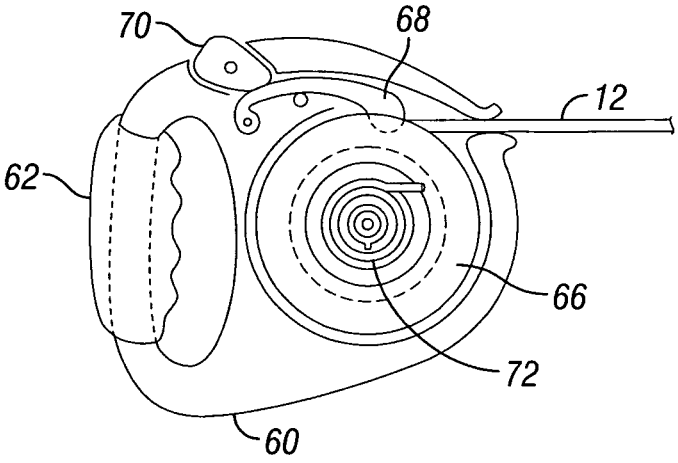
FIG. 7 is a view of an alternate embodiment of a strap housing with an integral handle, and illustrating a strap length lock mechanism.

FIG. 7 is a view of an alternate embodiment of a strap housing 60 with an integral foam molded grip handle 62, and illustrating a strap length lock mechanism 64. Strap segment 12 coils around strap drum 66 such that friction cam or brake 68 locks the strap in position unless released by thumb brake release 70. Clock spring return 72 may provide a normal bias to retract the strap segment 12. The internal mechanism may release the strap segment so that it can be pulled out to the length desired by the user, or so that without having force applied to it, the strap will retract by means of the spring.

The preferred strap release-or-retract mechanism is different from many release-or-retract mechanisms in that it is designed to allow the user to release or retract when the user pushes the actuating button or other means. Hence under normal operation without pushing the button, the length of the strap will remain secure at a specific length. Many other release-or-retract mechanisms have tapes or lines which are free wheeling to be pulled out or retracted back where there is an absence of pulling out. Getting the strap to stay secure requires pushing a button or actuating means. The unique mechanism of this invention allows the to user maintain a given length while doing exercises without having to push a button or secure the strap at a given length. Securing at a given length only requires releasing a button or other means. It is when the user wishes to change the length that the button or other means is pushed or actuated.

Figure 8:
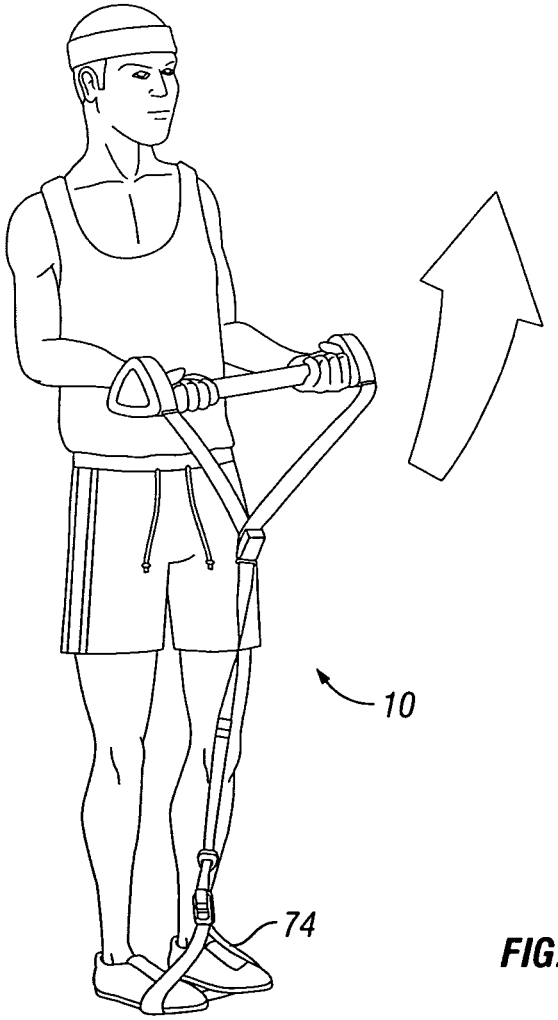
FIG. 8 is a view of an exercise being performed with the inventive apparatus.

FIG. 8 is a view of an exercise being performed with the inventive apparatus 10, with the user's feet anchoring the loop or stirrup 74. The retractable strap and resistance band are arranged so that at various lengths or settings, exercises can be performed with the appropriate dimensions with respect to among other things a) body and limb size, b) comfortable, manageable reach, and c) proper biomechanics. The kinds of exercises preformed with this device include strengthening, aerobics, endurance, stretching, and a variety of other exercises beneficial for general fitness, rehabilitation, Pilates, yoga, and sports training.

The above disclosure is sufficient to enable one of ordinary skill in the art to practice the invention, and provides the best mode of practicing the invention presently contemplated by the inventor. While there is provided herein a full and complete disclosure of the preferred embodiments of this invention, it is not desired to limit the invention to the exact construction, dimensional relationships, and operation shown and described. Various modifications, alternative constructions, changes and equivalents will readily occur to those skilled in the art and may be employed, as suitable, without departing from the true spirit and scope of the invention. Such changes might involve alternative materials, components, structural arrangements, sizes, shapes, forms, functions, operational features or the like.

Therefore, the above description and illustrations should not be construed as limiting the scope of the invention, which is defined by the appended claims.

What is claimed as invention is:

1. A modular exercise and fitness apparatus, said apparatus comprising:

a substantially nonelastic strap segment having a first end and a second end;

a strap housing connected to said strap segment first end, said strap housing including means for locking said strap segment at a desired length of extension from said strap housing;

an elastic resistance band having a first end and a second end and tapered along its length so that one end has reduced-cross-sectional area, said elastic resistance band first end connected to said strap segment second end; and an anchor point releasably connected to said elastic resistance band second end.

2. The modular exercise and fitness apparatus of claim 1 wherein said anchor point comprises a loop.

3. The modular exercise and fitness apparatus of claim 2 wherein said anchor point comprises a cuff.

4. The modular exercise and fitness apparatus of claim 3 wherein said cuff is inflatable and includes a pump to adjust pressure and fit.

5. The modular exercise and fitness apparatus of claim 1 wherein said anchor point comprises a shoe.

6. The modular exercise and fitness apparatus of claim 1 wherein said strap housing is affixed to a glove.

7. The modular exercise and fitness apparatus of claim 1 wherein said strap housing is affixed to a mat.

8. The modular exercise and fitness apparatus of claim 1 wherein said strap housing is affixed to a bracket for connection to a fixed structure.

9. The modular exercise and fitness apparatus of claim 1 wherein said strap housing includes a hand strap.

10. The modular exercise and fitness apparatus of claim 1 wherein said strap housing includes a handle grip.

11. The modular exercise and fitness apparatus of claim 10 wherein said handle grip comprises a secondary housing and bar handle connected to said strap housing.

12. The modular exercise and fitness apparatus of claim 1 wherein said strap segment bears length indicia.

13. The modular exercise and fitness apparatus of claim 12 wherein said length indicia comprise a plurality of colored portions to indicate strap length deployed.

14. The modular exercise and fitness apparatus of claim 1 wherein said resistance band bears length indicia.

15. The modular exercise and fitness apparatus of claim 1 wherein resistance band includes means for length adjustment.

16. The modular exercise and fitness apparatus of claim 1 wherein resistance band second end bears a loop to capture slack.

17. The modular exercise and fitness apparatus of claim 1 wherein said means for locking said strap segment at a desired length of extension comprises a strap release mechanism, and said strap segment is spring biased to normally retract into said strap housing when said strap release mechanism is actuated.

18. The modular exercise and fitness apparatus of claim 17 wherein actuation of said strap release mechanism enables deployment of said strap segment from said strap housing to adjust the length of said strap segment.

19. The modular exercise and fitness apparatus of claim 1 wherein said strap segment bears length indicia.

20. A modular exercise and fitness apparatus, said apparatus comprising:

a substantially nonelastic strap segment having a first end and a second end;

a strap housing connected to said strap segment first end, said strap housing including means for locking said strap segment at a desired length of extension from said strap housing;

an elastic resistance band having a first end and a second end, at least one of said ends having reduced cross-sectional area, said elastic resistance band first end connected to said strap segment second end; and an anchor point releasably connected to said elastic resistance band second end.

21. A modular exercise and fitness apparatus, said apparatus comprising:

a substantially nonelastic strap segment having a first end and a second end;

a strap housing connected to said strap segment first end, said strap housing including means for locking said strap segment at a desired length of extension from said strap housing;

an elastic resistance band having a first end and a second end and tapered along its length from wider to narrower, said elastic resistance band first end connected to said strap segment second end; and an anchor point releasably connected to said elastic resistance band second end.

* * * * *